US005931097A

United States Patent [19]

Neifert et al.

[11] Patent Number: 5,931,097

[45] Date of Patent: Aug. 3, 1999

[54] LASER IMAGEABLE LITHOGRAPHIC PRINTING MEMBER

[75] Inventors: Stephen R. Neifert, Sebastopol; Wilfred C. Kittler, Jr., Santa Rosa; Charlotte LeGallee, Geyserville, all of Calif.

[73] Assignee: Flex Products, Inc., Santa Rosa, Calif.

[21] Appl. No.: 09/089,291

[22] Filed: Jun. 1, 1998

Related U.S. Application Data

[63] Continuation of application No. 08/835,835, Apr. 23, 1997, Pat. No. 5,868,074, which is a continuation of application No. 08/436,119, May 8, 1995, abandoned.

[51] Int. Cl.[6] ..... B41N 1/14

[52] U.S. Cl. ..... 101/454; 101/457; 101/462

[58] Field of Search ..... 101/453, 454, 101/457, 460, 462, 463.1, 467

[56] References Cited

U.S. PATENT DOCUMENTS

| | | | |
|---|---|---|---|
| Re. 35,512 | 5/1997 | Nowak et al. | 101/454 |
| 5,188,032 | 2/1993 | Lewis et al. | 101/453 |
| 5,339,737 | 8/1994 | Lewis et al. | 101/457 |
| 5,378,580 | 1/1995 | Leenders | 101/467 |
| 5,379,698 | 1/1995 | Nowak et al. | 101/457 |
| 5,411,838 | 5/1995 | Strandjord et al. | 430/270.12 |

FOREIGN PATENT DOCUMENTS

| | | | |
|---|---|---|---|
| 1050805 | 3/1979 | Canada . | |
| 573091 | 12/1993 | European Pat. Off. | 101/467 |
| 573092 | 12/1993 | European Pat. Off. | 101/467 |

*Primary Examiner*—Stephen R. Funk
*Attorney, Agent, or Firm*—Workman, Nydegger & Seeley

[57] ABSTRACT

A laser imageable direct write printing member for use with a laser producing laser radiation comprising a flexible sheet of plastic having first and second surfaces serving as a film substrate. A vacuum-deposited laser ablative coating is carried by said first surface formed of a metal selected from a group consisting of titanium, zirconium, aluminum hafnium and alloys thereof.

10 Claims, 1 Drawing Sheet

LASER IMAGEABLE LITHOGRAPHIC PRINTING MEMBER

CROSS-REFERENCES TO RELATED APPLICATIONS

This application is a continuation of U.S. application Ser. No. 08/835,835 filed Apr. 23, 1997, now U.S. Pat. No. 5,868,074, which is a continuation of U.S. application Ser. No. 08/436,119, filed May 8, 1995, now abandoned.

FIELD OF THE INVENTION

This invention relates to a lithographic laser imageable direct-write film and a printing member incorporating the same.

BACKGROUND OF THE INVENTION

Heretofore aluminum plates have typically been utilized to provide the dimensional stability required for multiple plate registration in color printing applications and to achieve the durability required for long printing press runs. Aluminum substrates typically 5 to 20 mils in thickness required treatment such as graining and anodizing to provide adhesion for the subsequent coatings of light sensitive layers of organic compounds or emulsions for improved ink retention. In certain applications, polyester plates have been utilized typically only in black and white or spot color printing because of the lack of dimensional stability required for process color printing. Although polyester plates are inexpensive to produce and can be handled in raw form for surface coating processes, such plates are limited to short printing press runs. There is therefore a need for a new and improved printing member which overcomes these disadvantages.

SUMMARY OF THE INVENTION

In general, it is an object of the present invention to provide a lithographic laser imageable printing member which does not require the preparation of metal surfaces for printing.

Another object of the invention is to provide a printing member of the above character in which laser imageable coatings are carried by a thin film substrate which can be adhered to or laminated to a thicker substrate to provide the desired dimensional stability.

Another object of the invention is to provide a printing member of the above character in which a laser ablative coating is carried by the thin film substrate.

Another object of the invention is to provide a film of the above character in which the laser ablative coating is a vacuum-deposited metal selected from the group of titanium, zirconium, aluminum, hafnium and alloys thereof.

Another object of the invention is to provide a film of the above character in which an image coating has a different affinity from that of the film substrate for at least one printing liquid selected from the group consisting of ink and an abhesive fluid for ink to provide the desired image areas.

Another object of the invention is to provide a film substrate of the above character in which the film substrate after formation of the vacuum-deposited laser ablative coating and the image coating thereon can be adhered to a base substrate.

Another object of the invention is to provide a film substrate and printing member of the above character which makes it possible to substantially reduce costs of production.

BRIEF DESCRIPTION OF THE DRAWINGS

Additional objects and features of the invention will appear from the following description in which the preferred embodiments are set forth in detail in conjunction with the accompanying drawings.

DETAILED DESCRIPTION OF THE PREFERRED EMBODIMENTS

In general, the laser imageable direct write film of the present invention is for use with a laser producing infrared radiation and is comprised of a flexible film of a plastic having first and second surfaces. A vacuum-deposited laser ablative coating is carried by the first surface and is formed of a material selected from a group of metals consisting of titanium, zirconium, aluminum and hafnium and alloys thereof.

Figure 1:
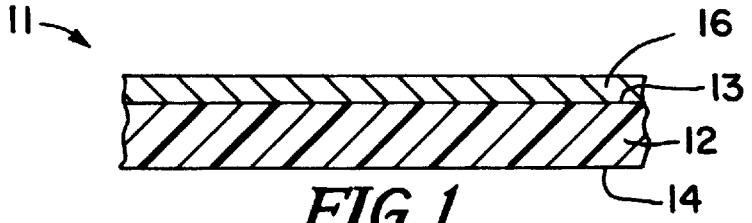
FIG. 1 is a cross-sectional view of a film substrate incorporating the present invention having a vacuum-deposited laser ablative coating thereon.

More specifically as shown in FIG. 1 of the drawings, the lithographic laser imageable direct-write film 11 consists of a flexible film substrate 12 in sheet form having upper and lower parallel spaced-apart surfaces 13 and 14. The film substrate 12 can be formed of a suitable material such as a polyester or a polymer and can have a thickness ranging from 0.2 to 10 mils and preferably a thickness ranging from 1–2 mils. It is desirable that the sheet 12 have good dimensional stability to serve as a film substrate which is provided by PET (polyethyleneterephthalate). By way of example, ICI 442 (2 mil thickness) and H 3930 (7 mil thickness) can be used. It should be appreciated that the quality of the surface desired for the printing application in which the film substrate is to be used is determined by the quality of the surface 13.

After the desired film substrate 12 has been selected, the film substrate 12 in sheet form typically is placed in rolls so that the sheet material can be advanced through a vacuum chamber in a conventional roll coater. During advancement through the roll coater, a laser ablative coating 16 is vacuum-deposited onto the surface 13. By way of example, rolls of sheet film substrate 12 having a width ranging from 3 to 6 feet and having a length of 10,000 linear feet and greater can be used.

In connection with the present invention, a metal is selected from the group of titanium, zirconium, aluminum hafnium and alloys thereof. These metals have been selected to be efficient laser ablative or laser energy absorption thin films. Such metals should have large h and k values so that they are good laser energy absorbers at the laser wavelength. Typically a single ablative or laser energy absorption metal layer is deposited. However, additional layers can be used as hereafter described. The deposition can take place by sputtering or thermal vaporization. The vacuum-deposited laser ablative or laser energy absorption coating 16 is typically deposited to a thickness ranging from about 5 Å to 400 Å and preferably a thickness of less than 200 Å. The metal ablative or laser energy absorption metal coating 16 can be vacuum-deposited to the desired thickness in a single pass or multiple passes through the roll coater by resistive heating, electron beam heating or sputtering of the metal.

Figure 2:
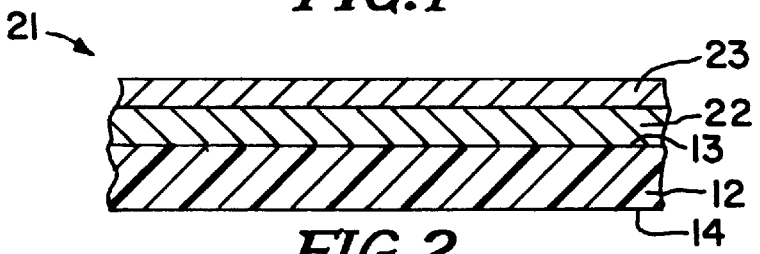
FIG. 2 is a cross-sectional view similar to FIG. 1 showing the use of a bilayer for the ablative coating.
Figure 3:
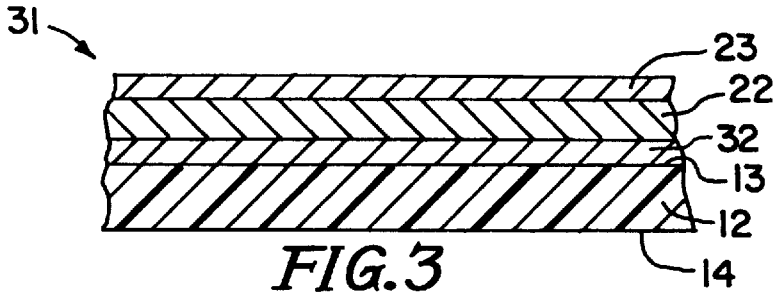
FIG. 3 is a cross-sectional view similar to FIG. 1 showing the use of a trilayer for the ablative coating.

When an ablative or laser energy absorption metal coating is desired to be formed of multiple layers, a bilayer such as shown in FIG. 2 or a trilayer as shown in FIG. 3 can be utilized. Such multiple layers are desired when a highly reactive metal forms a part of the ablative or laser energy absorption coating. Highly reactive metals, as for example, zirconium and hafnium are more sensitive to infrared laser energy and thus their use is desirable in the present invention. As shown in the direct-write film 21 in FIG. 2, a highly reactive metal such as zirconium or hafnium is vacuum-deposited onto the surface 13 of the sheet 12 in a roll coater by resistive heating, electron beam heating or sputtering to form a reactive metal layer 22 having a thickness ranging from 50–200 Å. Thereafter, a protective layer 23 of a metal such as titanium is vacuum-deposited in the roll coater over the layer 22 to a thickness ranging from 5 to 50 Å and preferably 5 to 20 Å to provide a bilayer. The layer 23 prevents oxidation of the reactive metal layer 22.

When additional protection is desired for the reactive metal layer 22, a direct-write film 31 as shown in FIG. 3 can be utilized in which a thin metal layer 32 is vacuum-deposited in the roll coater onto the surface 13 of the film substrate 12 prior to the deposition of the thicker reactive metal layer 22. It is deposited to a suitable thickness of from 5–50 Å and preferably a thickness of 5–20 Å. Although the film substrate 12 provides some protection to the adjacent side of the reactive metal layer 22, the additional protective layer 32 provides additional protection from oxidation and thus serves as a surface passivation layer. Thus, it can be seen that at least one of the first and second surfaces of the reactive metal layer 22 is covered by a layer of titanium as shown in FIG. 2 and both the first and second surfaces of the reactive metal layer 22 are covered by titanium layers 23 and 32 as shown in FIG. 3. It should be appreciated that the use of titanium is exemplary and the protective layer may be comprised of other metals which have resistance to oxidation as for example nickel, chromium, alloys thereof, stainless steel and like materials.

Figure 4:
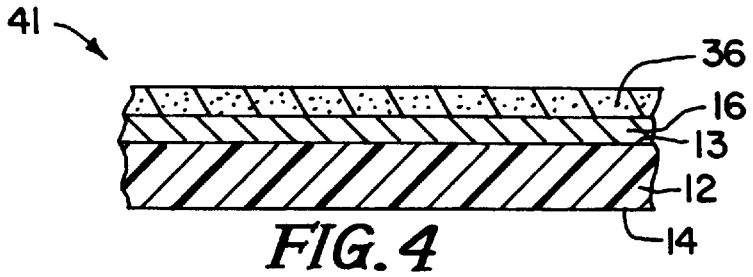
FIG. 4 is a cross-sectional view similar to that shown in FIG. 1.but having an additional coating thereon having a different affinity from that of the film substrate for at least one printing liquid selected from the group consisting of ink and an abhesive fluid for fluid for ink.

After the vacuum-deposited laser ablative or laser energy absorption coating has been applied in the manner hereinbefore described, the film substrate 12 can be removed in roll form from the roll coater after which the film substrate 12 is subjected to a conventional coating process which typically is a wet process at atmospheric pressure and thus typically is carried out at another location or facility. Since the film substrate is in roll form, the organic material coating process also is accomplished in a roll-coating operation in which the organic material is applied to the exposed surface of the vacuum-deposited laser ablative coating 16 (FIG. 1) coating 23 and 22 (FIG. 2) and coating 23, 22 and 32 (FIG. 3). Thus, as shown in FIG. 4, an organic coating 36 is applied to the layer 16 to form an image coating. Such organic coatings are applied in a manner well known to those skilled in the art in which a thin organic coating 36 is applied to the surface of the ablation coating 16. Solvents therein are evaporated by ultraviolet or thermal heating until the organic coating 36 has dried. Alternatively, if desired, the organic coating 36 can be applied by lamination of a solidified layer of the organic material coating 36 to the ablative coating 16 by suitable means such as an adhesive applied to the surface of the ablation coating 16 or the coating 36 and thereafter laminating the organic coating 36 onto the ablative coating 16. This provides a direct-write film 41. Similar direct-write films can be prepared by the application of organic material coatings for layers 36 to the structures shown in FIGS. 2 and 3.

The organic material coating 36 is prepared so that it has hydrophilic or hydrophobic and oleophillic or oleophobic characteristics with respect to the printing ink or inks to be utilized with the direct-write films of the present invention. By way of example, the organic material coating can be in the form of an oleophobic material such as a silicone polymer that repels ink. Alternatively it can be in the form of a hydrophilic material such as polyvinyl alcohol which absorbs water. The coating 36 is typically deposited to a thickness of 0.5 to 5.0 microns and preferably a thickness of 1 to 3 microns. The organic coating 36 can also be characterized as an image coating which exhibits an affinity different from that of the thin film substrate 12 for at least one printing liquid selected from the group consisting of ink and an abhesive fluid for ink.

Figure 5:
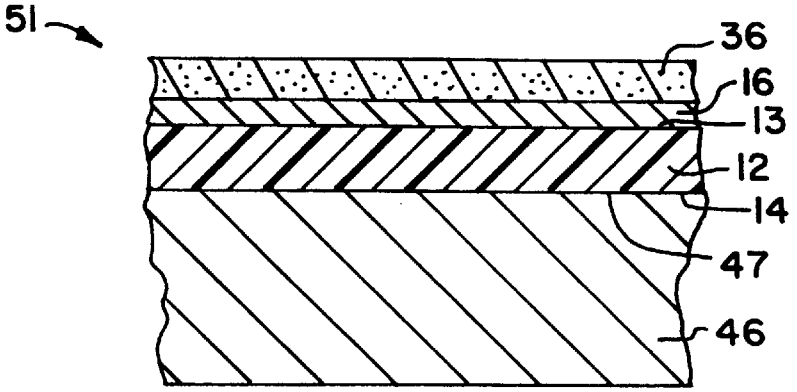
FIG. 5 is a cross-sectional view of a printing member incorporating the present invention having the film substrate shown in FIG. 4 incorporated therein onto a base substrate.

After the organic coating 36 has been dried, the coated film 41 as shown in FIG. 5 can be adhered to a base or base substrate 46 having an upper surface 47 to form a laser imageable direct-write printing member 51. The substrate 46 is formed of a suitable material such as aluminum or a polyester and has a thickness ranging from 5 to 20 mils. The lower surface 14 of the film substrate 12 is adhered to the surface 47 of the base substrate 46 by suitable means such as an adhesive (not shown) which can be disposed either on the surface 14 or on the surface 47 so that it is secured or laminated in a dimensionally stable configuration on the surface 47 of the substrate or base 46. The substrate or base 46 preferably should be dimensionally stable so that it will not have a maximum excursion in excess of 0.2 mil.

The composite printing member 51 shown in FIG. 5 can then be utilized and loaded directly into the printing press to be imaged or into an image setting machine where it can be imaged by lasers emitting energy at typically 850 nanometers to create images on the composite film 51. The image creation occurs because an ablation mechanism which is accomplished by the decomposition or gasification of the organic layer formed by the sheet 12 which results in ejection of the overlying laser energy absorbing layer 16. The polymeric layer 12 is heated to decomposition at temperatures as for example 265° C. (538 K) below the melting or vaporization temperature of the laser absorbing layer 16. It is advantageous that the laser absorbing layer not melt or vaporize since such a phase transition consumes laser energy without a corresponding temperature rise which would reduce ablation sensitivity. This is a very important consideration because laser diodes utilized in such applications typically have low power outputs.

Stated in another manner, the present invention can be characterized as one providing a lithographic printing member directly imageable by laser discharge. The member can be considered as being comprised of a top-most or first layer 36 (see FIG. 4) which is polymeric and a thin metal layer 16 underlying the first layer 36. A substrate 12 underlies the metal layer 16. Metal layer 16 is formed of a material which is subject to ablative absorption of imaging infrared radiation while the first layer 36 is not. The first layer 36 and the substrate 12 exhibit different affinities for at least one printing liquid selected from the group consisting of ink and an abhesive fluid for ink. The metal used for the thin metal layer can be titanium. The substrate 12 is laminated to a metal support 46 (see FIG. 5).

From the foregoing, it can be seen that the present invention consists of a laser imageable composite coating on a thin PET film substrate which is laminated to a backing sheet or substrate which can be formed of a metal such as aluminum, a plastic such as polyester, or even paper. The surface quality and printing action as well as the laser imaging coatings are carried by the surface of the thin PET film substrate. The vacuum-deposited laser ablative coating as well as the organic coating are thin film structures which absorb energy at the laser wavelength. These thin film structures absorb laser energy in very small volume resulting in local heating causing modification of the imaging surface which affects the ability of the surface to hold ink or reject ink. This invention makes it possible to eliminate the need to perform graining or other conditioning steps needed to prepare an aluminum surface for printing. It also provides the ability to utilize a low cost light weight thin substrate for deposition of the laser imageable coating. The use of the lightweight thin polymer film as for example PET film results in a greater coating capability in thin film roll coating machines which are used to produce the imageable coating of the present invention because longer rolls can be loaded into the roll coating machines. The use of the very thin polymer substrates has other advantages such as less deflection or indentation during printing leading to a longer plate life. By the use of thin absorbing metal layers coated onto polymer film substrates for imaging, a laminated structure is provided which gives the durability and dimensional stability of a conventional aluminum printing plate.

What is claimed:

1. A laser imageable direct write printing member for use with a laser producing laser radiation comprising:

a film substrate, said film substrate comprising a flexible sheet of plastic having first and second surfaces and having a thickness of 0.2 mils to 10 mils;

a vacuum-deposited laser energy absorption coating disposed on said first surface of said film substrate, said laser energy absorption coating being formed of titanium and having a thickness ranging from greater than 200 Å to 400 Å; and an image coating having an image surface and a bottom surface, said bottom surface disposed on the laser energy absorption coating, said image coating having a thickness ranging from 0.5 to 5 microns, wherein said image coating and laser energy absorption coating are ejected when laser energy is absorbed by the laser energy absorption coating to provide image areas on the image surface and non-image areas on the film substrate first surface, said image areas being oleophilic and adapted to be wetted with an oil-based ink, and said non-image areas being hydrophilic and adapted to be wetted with an aqueous solution or water.

2. A printing member as in claim 1, wherein the thickness of the film substrate is from 1 to 2 mils.

3. A printing member as in claim 1 further comprising a base substrate adhesively attached to the second surface of the film substrate, said base substrate having a thickness ranging from 7 to 20 mils.

4. A printing member as in claim 3, wherein said base substrate is formed of a metal.

5. A printing member as in claim 4 wherein said metal is aluminum.

6. A printing member as in claim 3 wherein said base substrate is formed of a plastic.

7. A lithographic laser imageable direct-write printing member comprising:

a base substrate having first and second surfaces and having a thickness ranging from 5 to 20 mils;

a thin film substrate formed of a polymeric material and having first and second surfaces, the second surface of the thin film substrate being disposed on and adhesively attached to the first surface of the base substrate;

a vacuum-deposited laser energy absorption coating disposed on the first surface of the thin film substrate, said laser energy absorption coating having a thickness ranging from greater than 200 Å to 400 Å and comprising a metal selected from titanium, zirconium, hafnium and alloys thereof; and an image coating having an image surface and a bottom surface, said bottom surface disposed on the laser energy absorption coating, said image coating having a thickness ranging from 0.5 to 3.0 microns, wherein said image coating and the laser energy absorption coating are ejected when laser energy is absorbed by the laser energy absorption coating to provide image areas on the image surface and non-image areas on the film substrate first surface, said image areas being oleophilic and adapted to be wetted with an oil-based ink, and said non-image areas being hydrophilic and adapted to be wetted with an aqueous solution or water.

8. A printing member as in claim 7, wherein said base substrate is formed of metal.

9. A printing member as in claim 7, wherein said base substrate is formed of plastic.

10. A printing member as in claim 7 wherein said metal includes titanium.

* * * * *

UNITED STATES PATENT AND TRADEMARK OFFICE

CERTIFICATE OF CORRECTION

PATENT NO. : 5,931,097

DATED : Aug. 3, 1999

INVENTOR(S) : Stephen R. Neifert; Wilfred C. Kittler, Jr.; Charlotte LeGallee

It is certified that error appears in the above-identified patent and that said Letters Patent is hereby corrected as shown below:

Col. 2, line 15, after "FIG." change "1.but" to --1. but--

Col. 5, line 45, after "and" insert --said--

Signed and Sealed this

Twenty-ninth Day of August, 2000

*Attest:*

*Attesting Officer*

Q. TODD DICKINSON

*Director of Patents and Trademarks*